US009636541B1

(12) United States Patent
Hsu

(10) Patent No.: US 9,636,541 B1
(45) Date of Patent: May 2, 2017

(54) HEEL-LIFTING ELLIPTICAL MACHINE

(71) Applicant: Kuan-Yung Hsu, Taichung (TW)

(72) Inventor: Kuan-Yung Hsu, Taichung (TW)

( * ) Notice: Subject to any disclaimer, the term of this patent is extended or adjusted under 35 U.S.C. 154(b) by 0 days.

(21) Appl. No.: 15/084,756

(22) Filed: Mar. 30, 2016

(51) Int. Cl.

| | |
|---|---|
| ***A63B 22/04*** | (2006.01) |
| ***A63B 22/02*** | (2006.01) |
| ***A63B 23/035*** | (2006.01) |
| ***A63B 23/04*** | (2006.01) |
| ***A63B 23/10*** | (2006.01) |

(52) U.S. Cl.
CPC ..... *A63B 22/04* (2013.01); *A63B 23/03525* (2013.01); *A63B 23/0405* (2013.01); *A63B 23/10* (2013.01)

(58) Field of Classification Search
CPC ..... A63B 22/04; A63B 23/10; A63B 23/0405; A63B 23/03525; A63B 22/06–22/0694
USPC ..... 482/51–54
See application file for complete search history.

(56) References Cited

U.S. PATENT DOCUMENTS 5,290,211 A * 3/1994 Stearns ..... A63B 21/00178 482/51
5,499,956 A * 3/1996 Habing ..... A63B 21/023 482/51
5,562,574 A * 10/1996 Miller ..... A63B 21/00178 482/51
5,595,553 A * 1/1997 Rodgers, Jr. ..... A63B 22/001 482/51
5,743,834 A * 4/1998 Rodgers, Jr. ..... A63B 22/001 482/51
5,769,760 A * 6/1998 Lin ..... A63B 22/001 482/51
5,997,445 A * 12/1999 Maresh ..... A63B 22/001 482/51
6,090,014 A * 7/2000 Eschenbach ..... A63B 22/001 482/52
6,152,859 A * 11/2000 Stearns ..... A63B 22/001 482/52
6,461,277 B2 * 10/2002 Maresh ..... A63B 22/001 482/51
7,201,706 B1 * 4/2007 Lee ..... A63B 22/001 482/52
7,785,235 B2 * 8/2010 Lull ..... A63B 22/001 482/52
2009/0093346 A1 * 4/2009 Nelson ..... A63B 22/001 482/52

* cited by examiner

*Primary Examiner* — Stephen Crow
*Assistant Examiner* — Garrett Atkinson
(74) *Attorney, Agent, or Firm* — Rosenberg, Klein & Lee

(57) ABSTRACT

A heel-lifting elliptical machine has a foundation, two linkage assemblies and two pedal assemblies. The foundation comprises a swing shaft and a driving wheel connected with a flywheel via a driving belt. The linkage assemblies are mounted on two sides of the foundation, staggered from each other, and joined to a driving shaft of the driving wheel. Each of the linkage assemblies comprises a rotation rod, a crank and a swing arm. The rotation rod is connected to the driving shaft. The crank is pivotably mounted on the other end of the rotation rod. The swing arm is pivotably mounted on the swing shaft and the crank. Two pedal assemblies are mounted securely on the cranks and form vertical ellipse routes along with the movement of the cranks, thereby increasing the exercise intensity and decreasing the obstruction and the noise.

9 Claims, 8 Drawing Sheets

HEEL-LIFTING ELLIPTICAL MACHINE

BACKGROUND OF THE INVENTION

1. Field of the Invention

The present invention relates to fitness equipment, especially to a heel-lifting elliptical machine.

2. Description of the Prior Arts

The conventional stepping machine comprises a foundation tiltably mounted with linkages, and the linkages are vertically staggered on the foundation and laterally disposed on two sides of the foundation. A free end of each one of the linkages comprises a pedal. A hydraulic or a pneumatic damper is mounted on a pivot shaft pivoted on the linkage, or a damper is directly mounted on the linkage, such that when the user steps on the pedals right and left alternately and make the linkages swing up and down, the user can exercise through the movement resisted by the damper.

However, because the linkage or the pivot shaft of the conventional stepping machine is mounted with the damper, the user may be directly aware of an obstruction and a noise generated by the damper when stepping on the pedals such that the stepping movement is not smooth. Besides, a movement route of the conventional stepping machine is simply up and down, and thus the user's feet cannot exercise in various ways.

Another fitness equipment is a conventional air walker machine, which allows the user's feet to move backward and forward alternately. The conventional air walker machine comprises a driving wheel of a foundation tiltably mounted with a linkage assembly, and the linkage assembly is mounted with pedals. When the user steps on the pedals, the stepping movement drives the linkage assembly to tilt and the driving wheel to rotate, and the pedals move along a sliding route backward and forward alternately such that the user can exercise on the conventional air walker machine.

Though an obstruction and a noise are inconspicuous, the conventional air walker machine merely provides the sliding route in backward and forward directions, so the user cannot do vertical aerobic exercise and the exercise intensity is inadequate.

To overcome the shortcomings, the present invention provides a heel-lifting elliptical machine to mitigate or obviate the aforementioned problems.

SUMMARY OF THE INVENTION

The main objective of the present invention is to provide a heel-lifting elliptical machine. Comparing to the conventional air walker machine which merely provides a back-and-forth route, the heel-lifting elliptical machine is capable of significantly decreasing the obstruction and the noise and increasing exercise intensity with vertical sliding.

The heel-lifting elliptical machine comprises:

a foundation comprising:

a swing shaft mounted on a lower portion of a front of the foundation;

a driving wheel which is uprightly rotatable and is mounted on an upper portion of a rear of the foundation, the driving wheel comprising:

a driving shaft formed in a center of the driving wheel;

a flywheel rotatably mounted on the foundation;

a driving belt connecting the driving wheel and the flywheel;

two linkage assemblies mounted on two sides of the foundation respectively, staggered from each other, and joined to the driving shaft, each of the linkage assemblies comprising:

a rotation rod, one end of the rotation rod rotatably mounted around the driving shaft;

a crank, an upper end of the crank pivotably mounted on another end of the rotation rod; and a swing arm, a front end of the swing arm pivotably mounted on the swing shaft, a rear end of the swing arm pivotably mounted on a lower end of the crank; and two pedal assemblies mounted securely on the cranks of the two linkage assemblies respectively, and being moveable in a vertical ellipse route with movements of the cranks.

A preferred heel-lifting elliptical machine, wherein each of the pedal assemblies comprises:

a support rod, a front end of the support rod mounted securely to the crank at a position adjacent to the lower end of the crank, and a rear end of the support rod extending toward the rear of the foundation;

a fixing rod mounted securely at the lower end of the crank and a middle of the fixing rod abutted on the support rod; and a pedal mounted securely on the support rod.

A preferred heel-lifting elliptical machine, wherein each of the cranks is formed an L-shaped, and comprises:

a tilt portion extending upward and pivotably mounted on said another end of the rotation rod; and a pedal-connecting portion below the tilt portion, extending toward the rear of the foundation, and the rear end of the swing arm pivotably mounted on a rear end of the pedal-connecting portion; and each of the pedal assemblies comprises:

a pedal mounted securely on the pedal-connecting portion of the crank.

A preferred heel-lifting elliptical machine, wherein the rotation rod comprises:

a first pivot shaft mounted at said another end of the rotation rod, the upper end of the crank mounted pivotably on the first pivot shaft; and a second pivot shaft mounted at the lower end of the crank, the rear end of the swing arm mounted pivotably on the second pivot shaft.

A preferred heel-lifting elliptical machine, wherein the foundation comprises a holding portion mounted on an upper portion of the foundation.

Instead of comprising a damper for generating resistance, the heel-lifting elliptical machine of the present invention may significantly decrease the obstruction and the noise. In addition, when the rotation rod drives the driving wheel to rotate in a circle, the pedal assemblies joined with the cranks provide a vertical ellipse route, and the pedals move along with the changing positions of the cranks and swing and tilt backward and forward continuously with respect to the foundation, such that the heels can be lifted and the ankles can swing along with the pedals.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
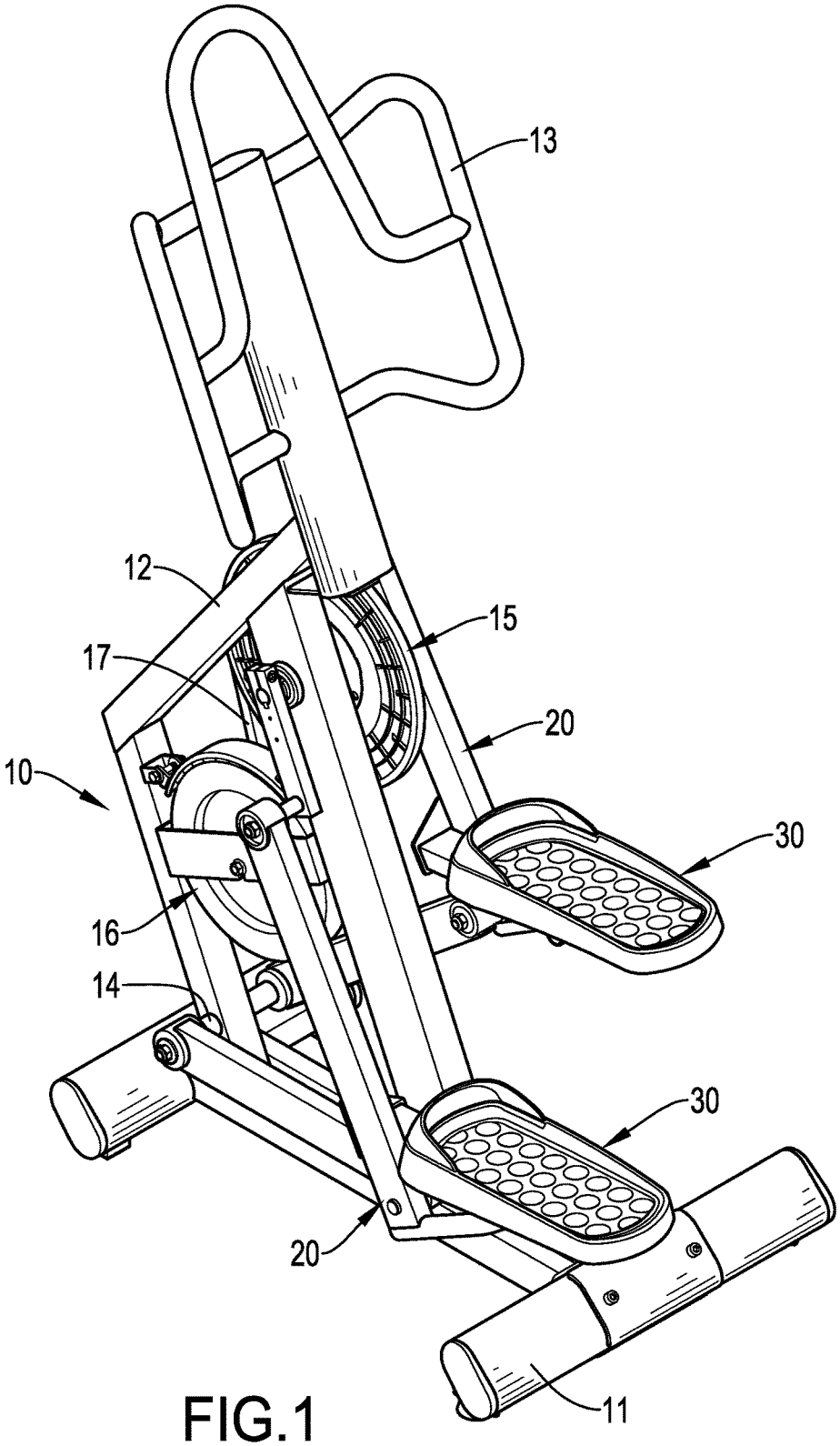
FIG. 1 is a perspective view of a heel-lifting elliptical machine in accordance with a first embodiment of the present invention.
Figure 2:
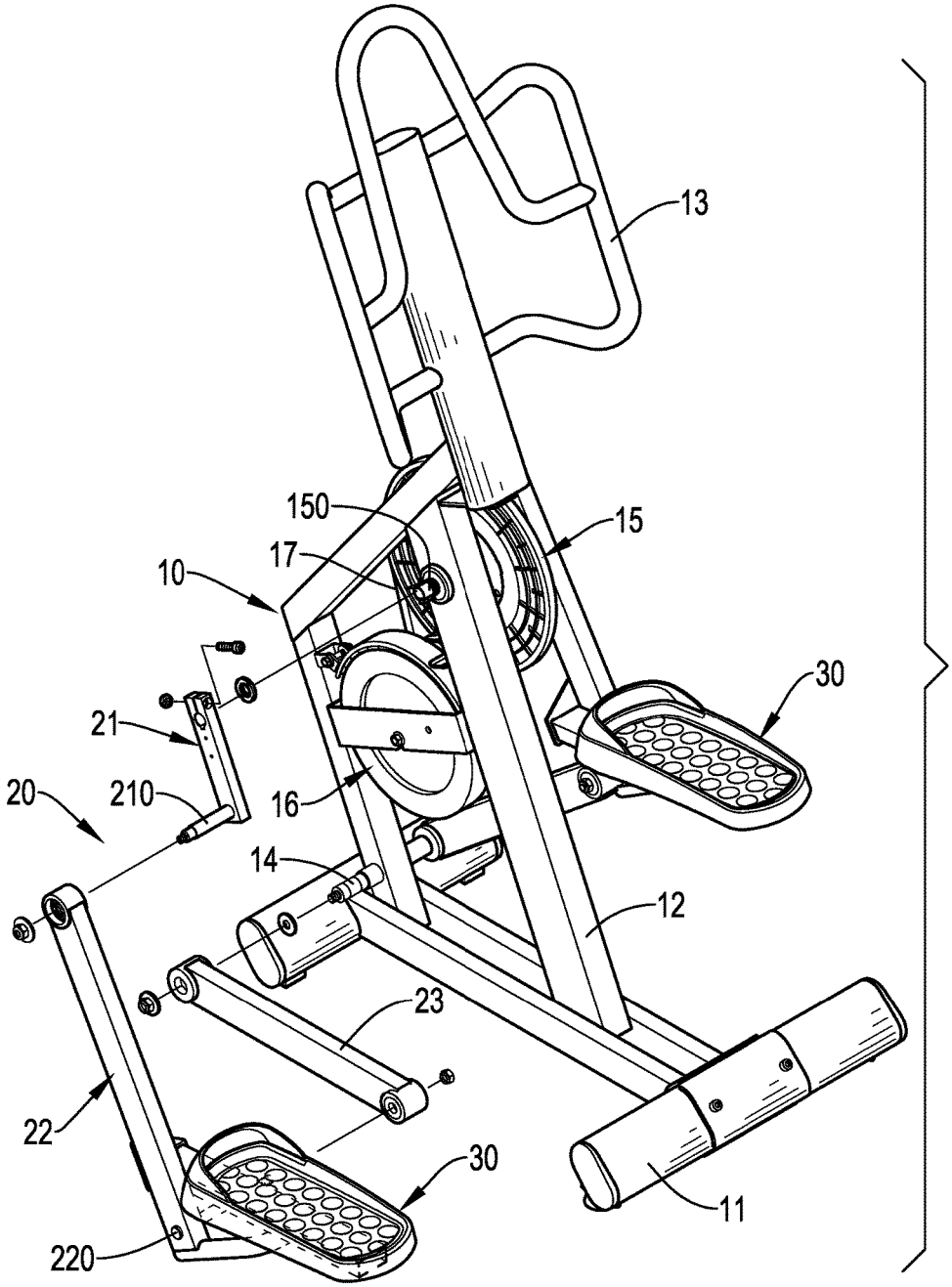
FIG. 2 is an exploded view of the heel-lifting elliptical machine in FIG. 1.
Figure 3:
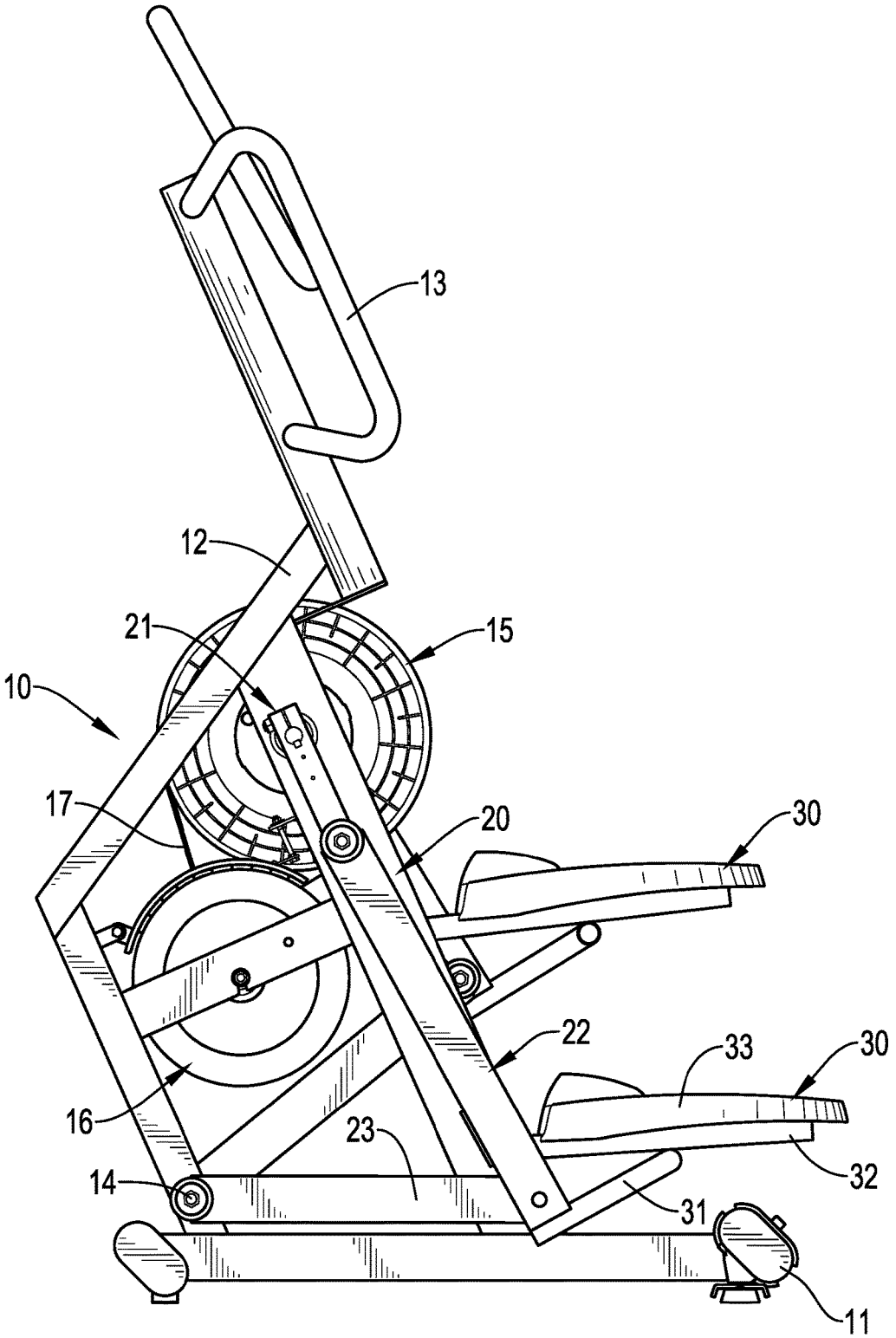
FIG. 3 is a lateral view of the heel-lifting elliptical machine in FIG. 1.
Figure 4:
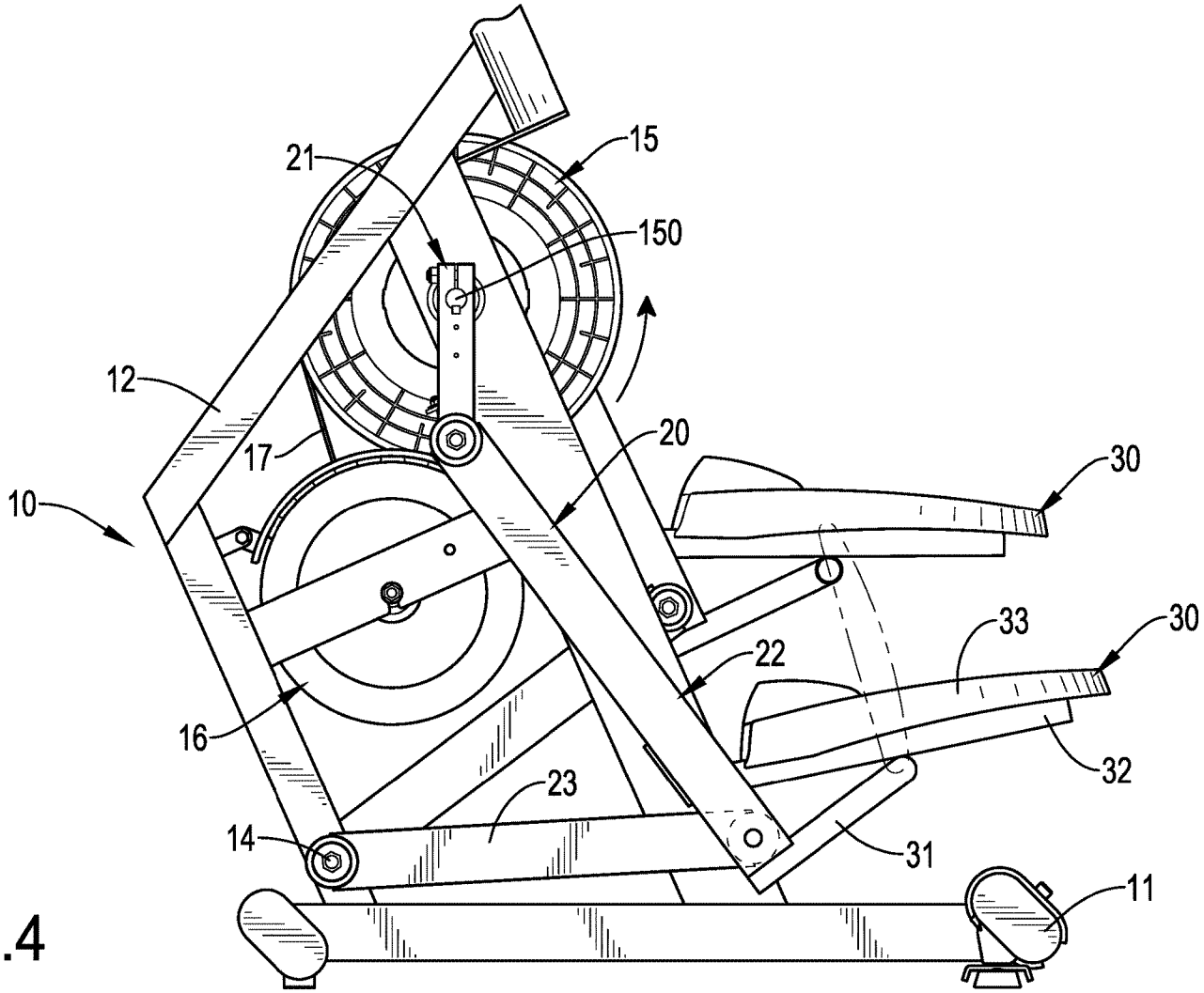
FIGS. 4 to 7 are partially enlarged serial action views of the heel-lifting elliptical machine in FIG. 1.
Figure 5:
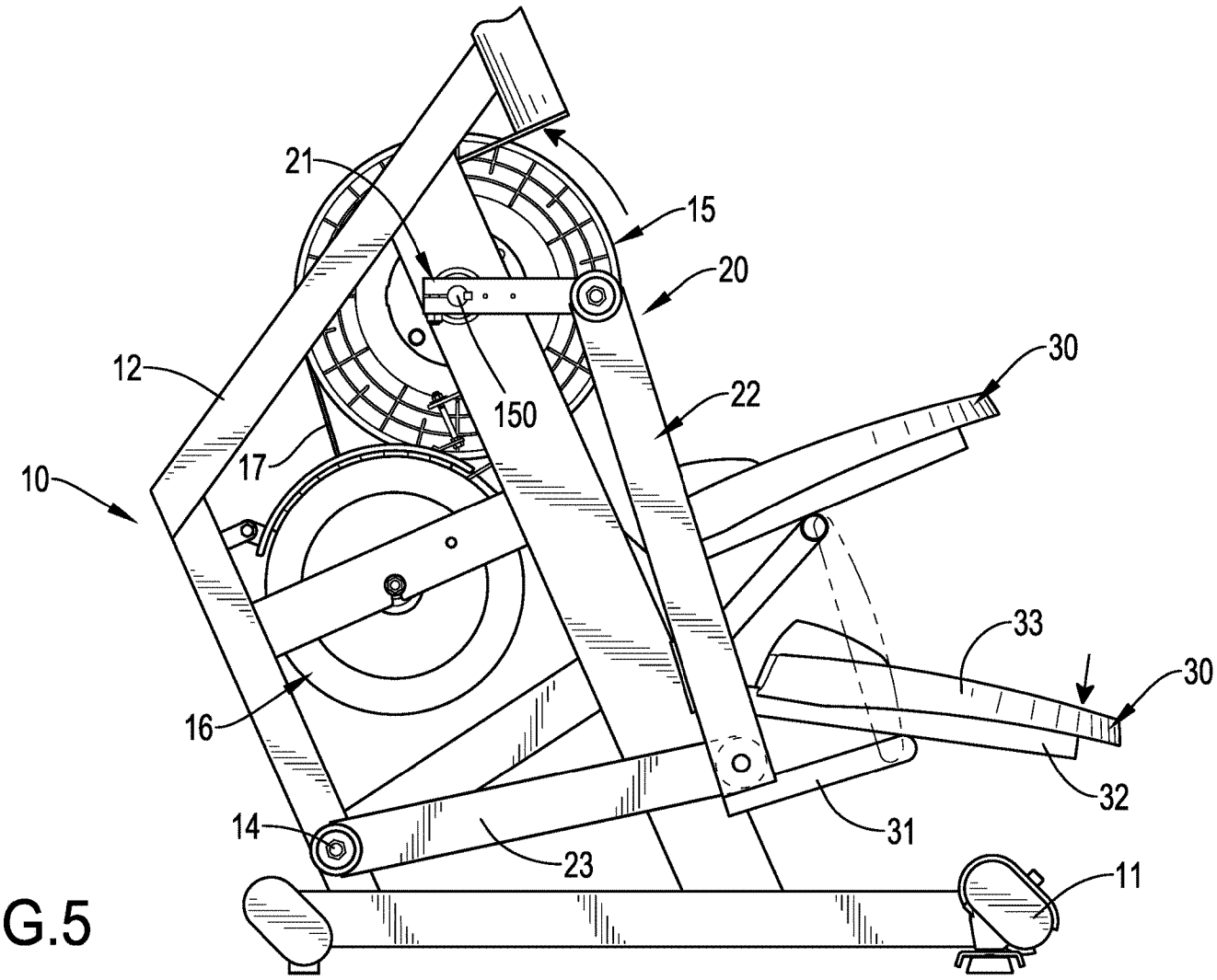
Figure 6:
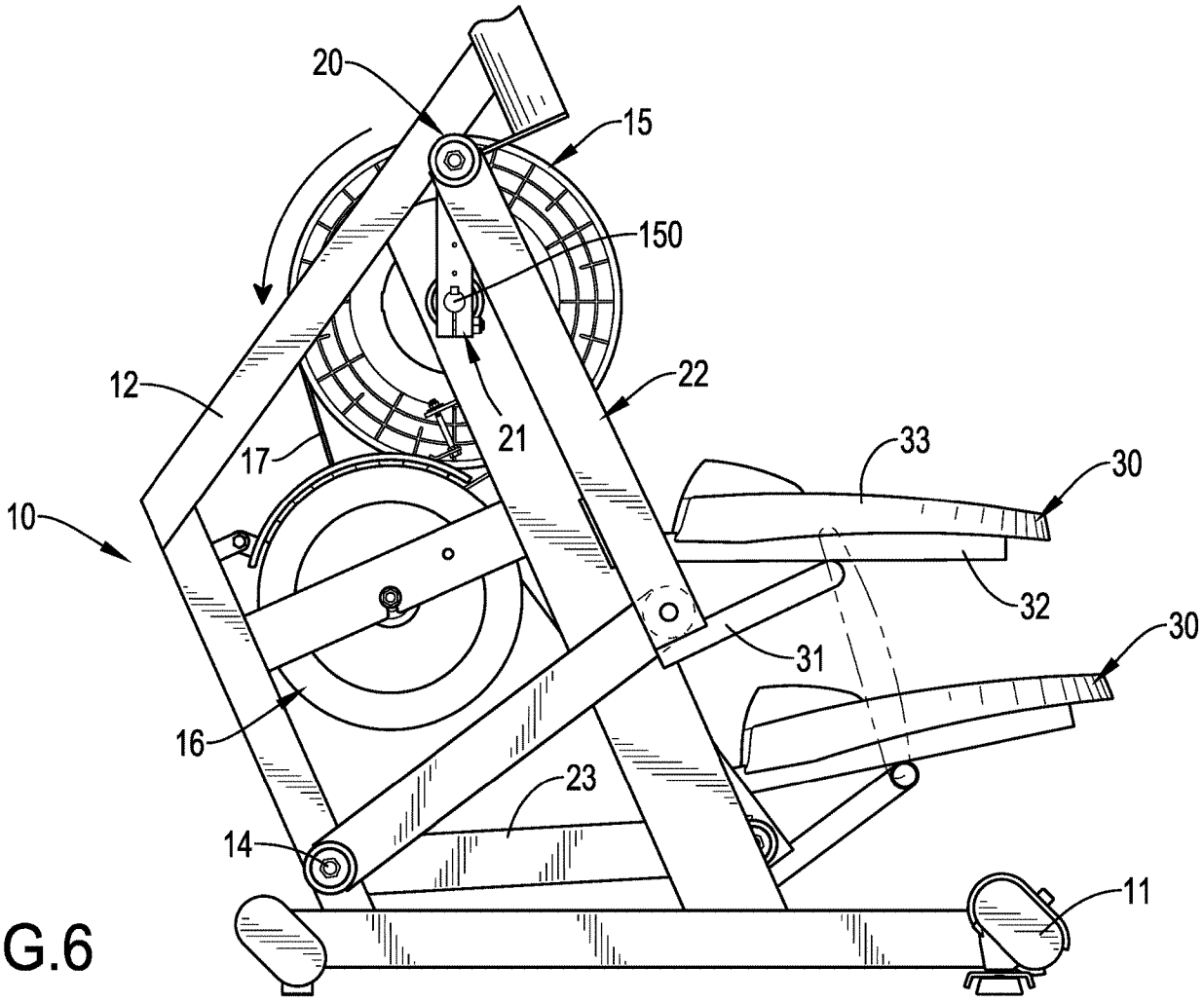
Figure 7:
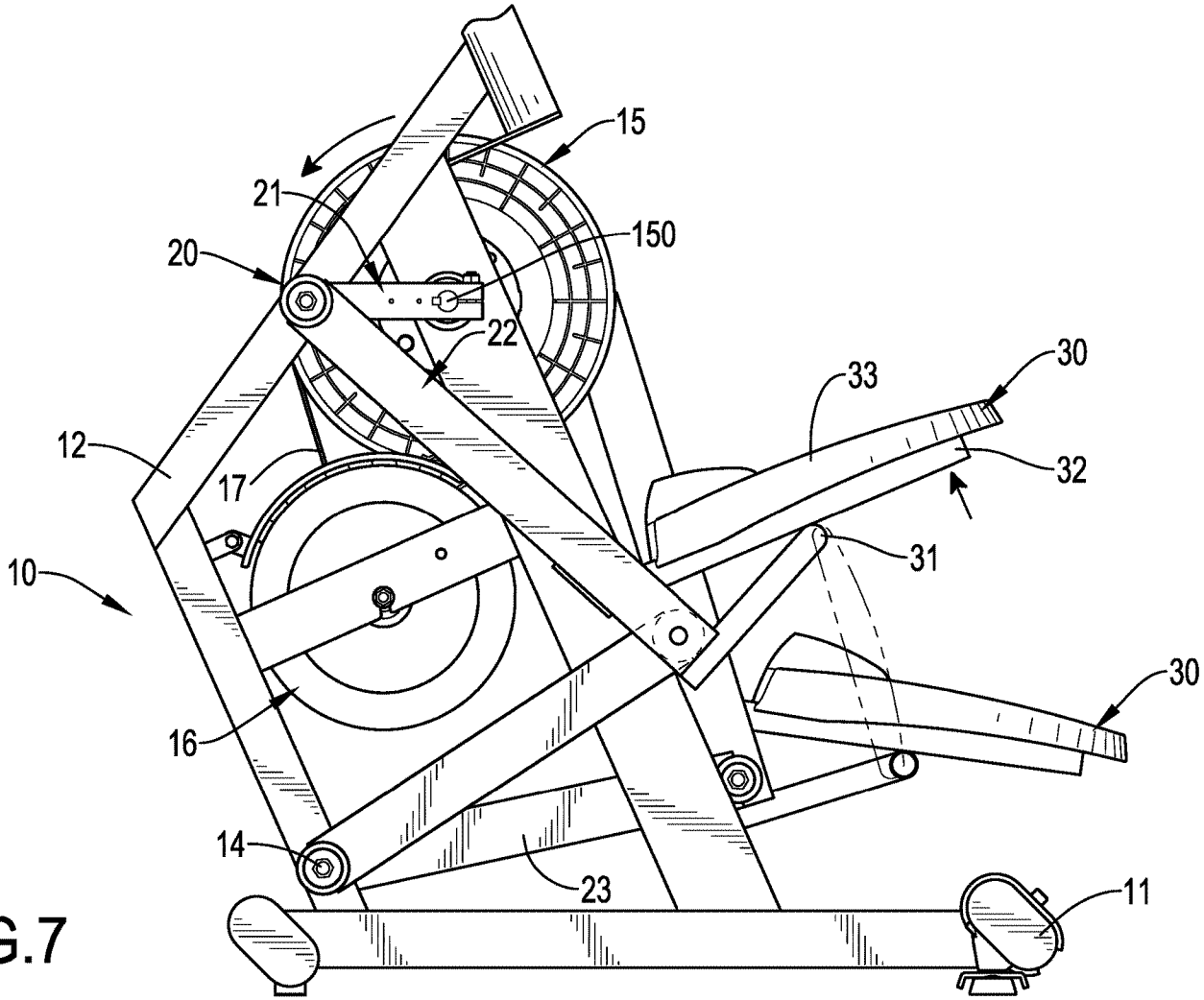

With reference to FIGS. 1 to 3, a heel-lifting elliptical machine in accordance with a first embodiment of the present invention comprises a foundation 10, two linkage assemblies 20 and two pedal assemblies 30. The foundation 10 forms an H-shaped base portion 11 at a bottom of the foundation 10, a quadrilateral frame portion 12 at a middle of the foundation 10, and a holding portion 13 at an upper portion of the foundation 10. The foundation 10 comprises a swing shaft 14, an uprightly rotatable driving wheel 15, a flywheel 16 and a driving belt 17. The swing shaft 14 is mounted on a lower portion of a front of the frame portion 12. The driving wheel 15 is mounted on an upper portion of a rear of the frame portion 12, and a center of the driving wheel 15 forms a driving shaft 150 which is rotatably mounted through the frame portion 12 of the foundation 10. The flywheel 16 is mounted on a middle of the frame portion 12 and corresponded to the driving wheel 15. The driving belt 17 connects to the driving wheel 15 and the flywheel 16.

The two linkage assemblies 20 are mounted on two sides of the frame portion 12 of the foundation 10 respectively, are staggered from each other, and are joined to two ends of the driving shaft 150 of the driving wheel 15. Each of the linkage assemblies 20 comprises a rotation rod 21, a crank 22 and a swing arm 23. An end of the rotation rod 21 is rotatably mounted around the driving shaft 150 of the driving wheel 15, and another end of the rotation rod 21 comprises a first pivot shaft 210. An upper end of the crank 22 is pivotably mounted on the first pivot shaft 210, and a lower end of the crank 22 comprises a second pivot shaft 220. A front end of the swing arm 23 is pivotably mounted on the swing shaft 14, a rear end of the swing arm 23 is pivotably mounted on the second pivot shaft 220 of the lower end of the crank 22.

The two pedal assemblies 30 are mounted securely adjacent to the lower ends of the two cranks 22 respectively. Each of the pedal assemblies 30 comprises a support rod 31, a fixing rod 32 and a pedal 33. A front end of the support rod 31 is mounted securely adjacent to the lower end of the crank 22, and a rear end of the support rod 31 extends toward the rear of the foundation 10. The fixing rod 32 is mounted securely at the lower end of the crank 22 and a middle of the fixing rod 32 is abutted on the support rod 31. The pedal 33 is mounted securely on the support rod 31.

With reference to FIGS. 1 and 4 to 7, when using the heel-lifting elliptical machine, the user steps on the pedals 33 of the two pedal assemblies 30 and holds the holding portion 13 of the foundation 10. When the user alternately stamps his feet on the pedals 33 and makes the feet exert a force on the pedals 33, the fixing rods 32 and the support rods 31 of the pedal assemblies 30 drive the cranks 22. At the meantime, the rotation rods 21 which are rotatably mounted with the upper ends of the cranks 22 move in circle routes around the driving shaft 150, and drive the driving wheel 15 and flywheel 16 to rotate via driving belt 17 such that the resistance can be adjusted. The lower ends of the cranks 22 drive the swing arms 23 to tilt up and down with respect to the swing shaft 14.

When the rotation rods 21 move along in the circle routes, the pedal assemblies 30 connected to the cranks 22 form vertical ellipse routes. The pedals 33 repeatedly swing backward and forward along with the changing positions of the cranks 22. With the user continuously stepping on the pedals 33, the pedal assemblies 30 repeatedly move along in the vertical ellipse routes (as the imaginary lines illustrated in FIGS. 4 to 7), and the pedals 33 tilt backward and forward continuously. Thus, the heels can be lifted and the ankles can swing slightly along with the pedals 33.

Figure 8:
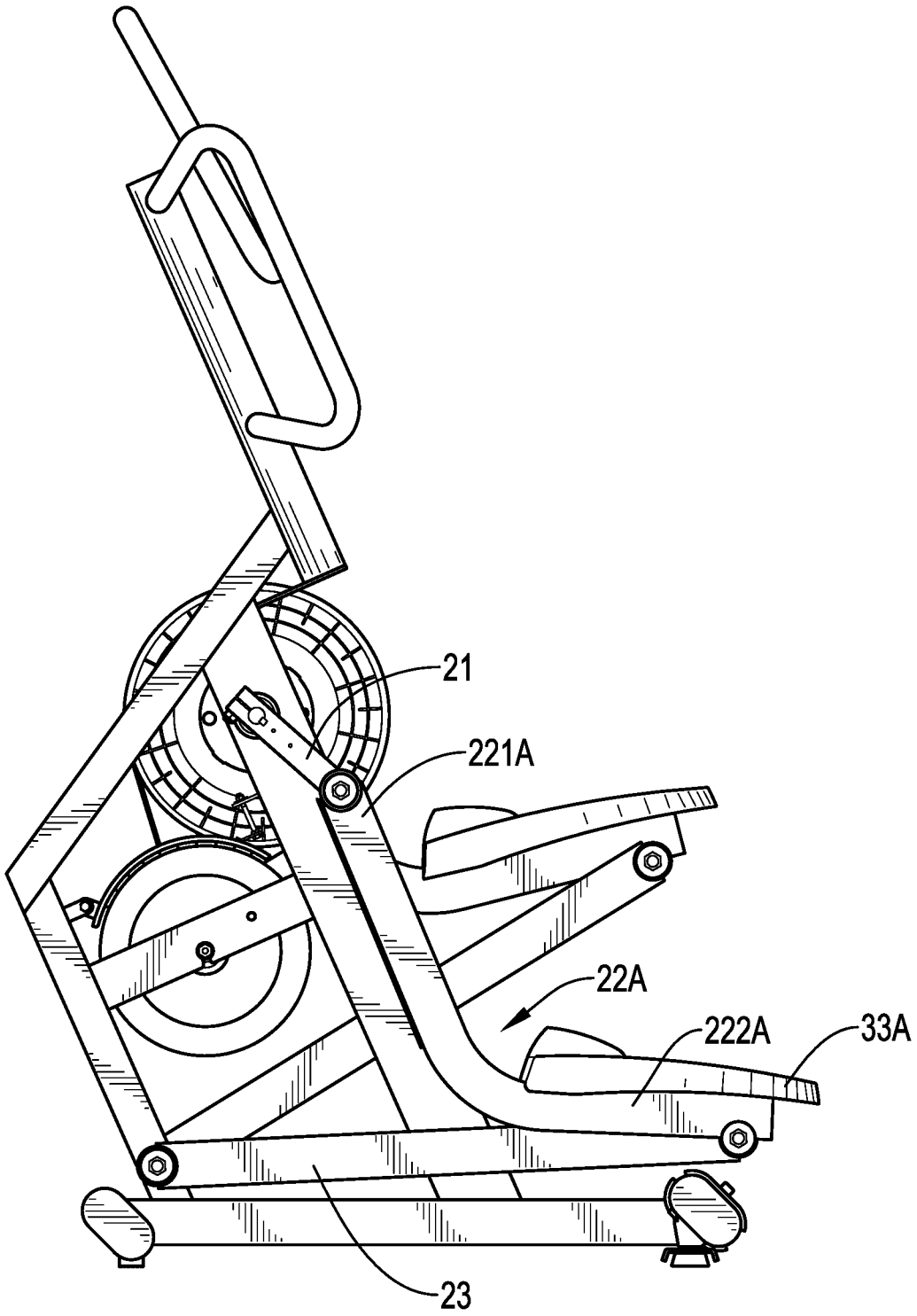
FIG. 8 is a lateral view of the heel-lifting elliptical machine in accordance with a second embodiment of the present invention.

With reference to FIG. 8, a heel-lifting elliptical machine in accordance with a second embodiment of the present invention is almost the same with the first embodiment of the present invention. The difference between the second embodiment and the first embodiment is that the support rod and the fixing rod are formed integrally with the crank 22A that is at the same side thereof. To more precisely, each of the cranks 22A comprises a tilt portion 221A and a pedal-connecting portion 222A, and each of the cranks 22A is formed an L-shaped. An angle between the tilt portion 221A and the pedal-connecting portion 222A is an obtuse angle. The tilt portion 221A extends upward, and a top end of the tilt portion 221A is pivotably mounted at said another end of the rotation rod 21. The pedal-connecting portion 222A is below the tilt portion 221A and extends toward the rear of the foundation 10. The rear end of the swing arm 23 is pivotably mounted on a rear end of the pedal-connecting portion 222A. The pedals 33A of the pedal assemblies 30 are mounted securely on and along with the pedal-connecting portion 222A of the cranks 22A respectively.

Instead of comprising a damper for generating resistance, the heel-lifting elliptical machine of the present invention comprises the pedal assemblies 30 connected to the cranks 22 which are connected to the rotation rod 21 for driving the driving wheel 15 and driving the flywheel 16 via the driving belt 17. Thus, the pedal assemblies 30 of the present invention do not directly connect to the driving wheel 15 and the flywheel 16, which decreases the obstruction and the noise significantly and makes the user feel smooth and comfortable.

In addition, comparing to the conventional air walker machine that only provides backward and forward routes and cannot provide adequate exercise intensity, the heel-lifting elliptical machine of the present invention provides higher exercise intensity with the linkage assemblies 20 which can drive the pedal assemblies 30 to move along in the vertical ellipse route. Besides, the exercise intensity also can be increased by the pedals 33 of the present invention swinging backward and forward along with the positions of the cranks 22 such that motion ranges of the ankles is broader.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A heel-lifting elliptical machine comprising:

a foundation comprising:

a swing shaft mounted on a lower portion of a front of the foundation;

a driving wheel being uprightly rotatable and mounted on an upper portion of a rear of the foundation, the driving wheel comprising:

a driving shaft formed in a center of the driving wheel;

a flywheel rotatably mounted on the foundation;

a driving belt connecting the driving wheel and the flywheel;

two linkage assemblies mounted on two sides of the foundation respectively, staggered from each other, and joined to the driving shaft, each of the linkage assemblies comprising:

a rotation rod, one end of the rotation rod rotatably mounted around the driving shaft;

a crank, an upper end of the crank pivotably mounted on another end of the rotation rod; and a swing arm, a front end of the swing arm pivotably mounted on the swing shaft, a rear end of the swing arm pivotably mounted on a lower end of the crank; and two pedal assemblies mounted securely on the cranks of the two linkage assemblies respectively, and being movable in a vertical ellipse route with movements of the cranks.

2. The heel-lifting elliptical machine as claimed in claim 1, wherein each of the pedal assemblies comprises:

a support rod, a front end of the support rod mounted securely to the crank at a position adjacent to the lower end of the crank, and a rear end of the support rod extending toward the rear of the foundation;

a fixing rod mounted securely at the lower end of the crank and a middle of the fixing rod abutted on the support rod; and a pedal mounted securely on the support rod.

3. The heel-lifting elliptical machine as claimed in claim 2, wherein the rotation rod comprises:

a first pivot shaft mounted at said another end of the rotation rod, the upper end of the crank mounted pivotably on the first pivot shaft; and a second pivot shaft mounted at the lower end of the crank, the rear end of the swing arm mounted pivotably on the second pivot shaft.

4. The heel-lifting elliptical machine as claimed in claim 3, wherein the foundation comprises a holding portion mounted on an upper portion of the foundation.

5. The heel-lifting elliptical machine as claimed in claim 1, wherein each of the cranks is formed an L-shaped, and comprises:

a tilt portion extending upward and pivotably mounted on said another end of the rotation rod; and a pedal-connecting portion below the tilt portion, extending toward the rear of the foundation, and the rear end of the swing arm pivotably mounted on a rear end of the pedal-connecting portion; and each of the pedal assemblies comprises:

a pedal mounted securely on the pedal-connecting portion of the crank.

6. The heel-lifting elliptical machine as claimed in claim 5, wherein the rotation rod comprises:

a first pivot shaft mounted at said another end of the rotation rod, the upper end of the crank mounted pivotably on the first pivot shaft; and a second pivot shaft mounted at the lower end of the crank, the rear end of the swing arm mounted pivotably on the second pivot shaft.

7. The heel-lifting elliptical machine as claimed in claim 6, wherein the foundation comprises a holding portion mounted on an upper portion of the foundation.

8. The heel-lifting elliptical machine as claimed in claim 1, wherein the rotation rod comprises:

a first pivot shaft mounted at said another end of the rotation rod, the upper end of the crank mounted pivotably on the first pivot shaft; and a second pivot shaft mounted at the lower end of the crank, the rear end of the swing arm mounted pivotably on the second pivot shaft.

9. The heel-lifting elliptical machine as claimed in claim 1, wherein the foundation comprises a holding portion mounted on an upper portion of the foundation.

* * * * *